US005133242A

United States Patent [19]

Witt

[11] Patent Number: 5,133,242

[45] Date of Patent: Jul. 28, 1992

[54] ELECTROMAGNETIC RAIL ACCELERATOR ARRANGEMENT

[75] Inventor: Wolfram Witt, Düsseldorf, Fed. Rep. of Germany

[73] Assignee: Rheinmetall GmbH, Düsseldorf, Fed. Rep. of Germany

[21] Appl. No.: 172,114

[22] Filed: Mar. 21, 1988

Related U.S. Application Data

[63] Continuation-in-part of Ser. No. 68,480, Jun. 12, 1987, Pat. No. 5,005,484, which is a continuation-in-part of Ser. No. 50,170, May 7, 1987, abandoned.

[30] Foreign Application Priority Data

May 9, 1986 [DE] Fed. Rep. of Germany ..... 3615585
Mar. 19, 1987 [DE] Fed. Rep. of Germany ..... 3708910

[51] Int. Cl.[5] ..... F41B 6/00

[52] U.S. Cl. ..... 89/8; 102/522; 102/523; 124/3

[58] Field of Search ..... 89/8; 102/501, 514, 102/515, 517, 520, 521, 522, 523; 124/3

[56] References Cited

U.S. PATENT DOCUMENTS 1,370,200 3/1921 Fauchon-Villeplee ..... 89/8
1,422,427 7/1922 Fauchon-Villeplee ..... 89/8
4,343,223 8/1982 Hawke et al. ..... 89/8
4,480,523 11/1984 Young et al. ..... 89/8
4,485,720 12/1984 Kemeny ..... 89/8
4,527,457 7/1985 Fikse ..... 89/8
4,577,545 3/1986 Kemeny ..... 89/8
4,677,895 7/1987 Carlson et al. ..... 89/8
4,913,030 4/1990 Reynolds ..... 89/8

FOREIGN PATENT DOCUMENTS 2206677 1/1989 United Kingdom ..... 124/3

*Primary Examiner*—Stephen C. Bentley
*Attorney, Agent, or Firm*—Spencer, Frank & Schneider

[57] ABSTRACT

An electromagnetic rail accelerator in which a plurality of plasma arc cushions are generated between a plurality of pairs of rails in order to accelerate projectiles. To prevent currents of different intensities from flowing through the individual plasma armatures and, thus subjecting the rails to relatively great wear, the number of rail pairs is made equal to the number of zones in which plasma arc cushions are formed. Preferably, the rail accelerator is composed of a rail arrangement in multiples of three, with the rails being disposed in or on the inner surface of a cylindrical tube of insulating material and with the current flowing in opposite directions in adjacent rails.

11 Claims, 4 Drawing Sheets

ELECTROMAGNETIC RAIL ACCELERATOR ARRANGEMENT

This application is a continuation in part of copending allowed U.S. patent application Ser. No. 068,480, filed Jun. 12th, 1987, now U.S. Pat. No. 5,005,484 which is a continuation in part of U.S. application Ser. No. 07/050,170, filed May 7th, 1987, now abandoned.

BACKGROUND OF THE INVENTION

The present invention relates to an electromagnetic rail accelerator arrangement wherein a plurality of plasma arc cushions are generated between the accelerator rails for the acceleration of projectiles and to the use of such rail accelerators to accelerate multiple projectile arrangements and projectiles including at least two successive propelling cage sabot segments separated by intermediate members.

Electromagnetic rail accelerator arrangements of the above-mentioned type for accelerating projectiles by means of a plurality of plasma arc cushions are disclosed, for example, and in Applicant's above-identified corresponding United States Patent Applications, the subject matter of which is incorporated herein by reference. Such rail accelerators are composed, in principle, of an acceleration member which, in the simplest case, is provided in the form of two parallel acceleration rails. These rails are traversed by current and simultaneously take over the lateral guidance of the projectile. When the current is switched on, the current flows along one rail, through the plasma armature disposed between the two rails, and back through the other rail. The magnetic fields thus produced between the rails, together with the current flowing through the plasma armature, produce a Lorentz force which accelerates the armature, and the projectile connected with the armature, out of the launching device. To realize the most uniform force transmission possible, the projectile is composed of at least two partial projectiles arranged one behind the other and separated by intermediate members so that a plasma armature forms at the rear or tail end of each of the partial projectiles.

A particular drawback of this prior rail accelerator is that all of the current required to generate the Lorentz force must be conducted over the two parallel rails. This causes currents of different intensities to flow through the individual plasma armatures. Moreover, these rails are subject to relatively great wear.

U.S. Pat. No. 4,480,523, issued Nov. 6th, 1984 discloses a tubular rail accelerator in which the rails are arranged in the form of a cylinder. However, these accelerators have the drawback that the current flows through the same rails, independently of the number of armatures, so that here again relatively great wear results in these arrangements.

SUMMARY OF THE INVENTION

It is therefore an object of the present invention to further develop an electromagnetic rail accelerator of the above-mentioned type in which the wear of the rails is substantially less, with the same projectile acceleration, than in prior rail accelerators.

The above object is generally achieved according to the present invention by an electromagnetic rail accelerator for the acceleration of a projectile arrangement defining a plurality of axially spaced zones in each of which a respective plasma arc cushion is to be generated, with the accelerator including at least one pair of parallel axially extending diametrically opposed conductive rails disposed in the inner surface of a cylindrical tube of insulating material, a source of d.c. voltage, and means for selectively connecting the source across the at least one pair of conductive rails; and wherein: a number of pairs of axially extending diametrically opposed conductive rails are provided and are uniformly disposed in the inner surface of said tube; the pairs of rails are all connected in parallel; and the number of pairs of rails is equal to the number of zones in which a respective plasma is to be formed.

The present invention is thus essentially based on the idea of employing a rail accelerator which has more than one pair of parallel rails, with the number of rail pairs being equal to the number of plasma-forming zones of the projectile. Less current is thus required per rail for the same projectile acceleration. All plasma-forming zones are traversed by a current of the same, Lorentz force determining, intensity. This reduces wear of the rails.

Additionally, the accelerator according to the present invention has a number of further advantages. Initially, there are fewer azimuthal changes of the Lorentz force acting on the tube, and thus the tube can be designed for greater stresses. Moreover, if a rail arrangement is provided wherein the number of rail pairs is based on multiples of three, e.g. 3, 6, 12, . . . pairs of rails, the accelerator can be constructed so that the current in adjacent rails flows in opposite directions. This results in a reduction of stray magnetic fields.

The invention will be described below in greater detail in connection with a number of embodiments and with reference to the drawing figures.

DETAILED DESCRIPTION OF THE PREFERRED EMBODIMENT

Figure 1:
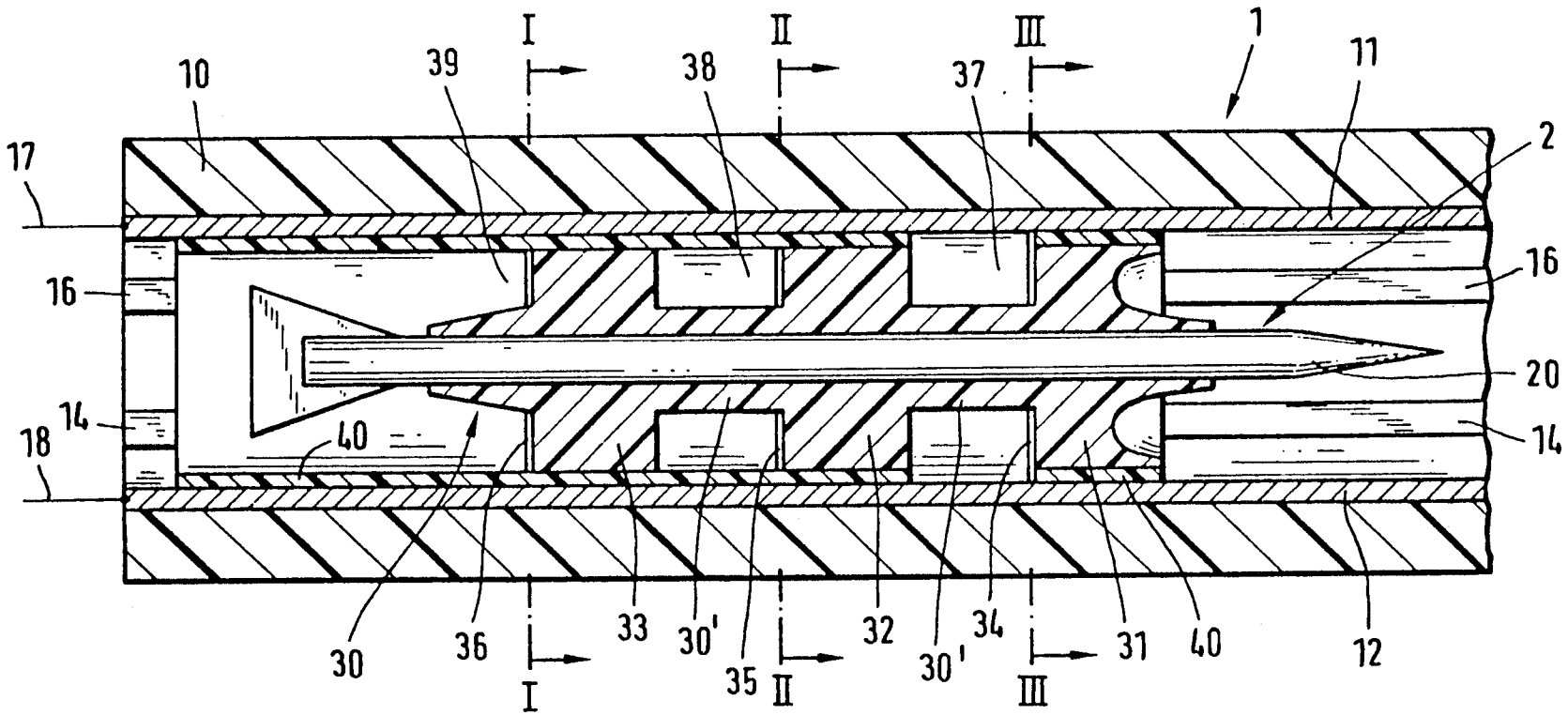
FIG. 1 is a longitudinal cross-sectional view of an electromagnetic rail accelerator and a projectile having three plasma-forming zones according to one embodiment of the invention.

Referring now to FIG. 1, there is shown a projectile 2 disposed in an electromagnetic rail accelerator 1. The electromagnetic rail accelerator 1 is composed essentially of a tube 10 made of insulating material of a sufficient strength and a plurality of longitudinally or axially extending pairs of parallel diametrically opposed rails 11-12, 13-14 and 15-16, with only the rail pair 11-12 being seen in FIG. 1 (see also FIGS. 2 to 4).

Projectile 2 is composed of a subcaliber penetrator 20 and a propelling cage sabot 30 to guide the penetrator 20 in the tube 10 of the rail accelerator. In the illustrated embodiment, propelling cage sabot 30 is composed of three radially extending, longitudinally spaced segments 31, 32 and 33 which are connected together by means of intermediate portions 30' of a lesser diameter. Disposed on the respective tail or rear end surfaces of the segments 31, 32 and 33 are respective plasma forming substances 34, 35 and 36, which are preferably metal films or foils as shown. Between the propelling cage sabot segments 31, 32 and 33, annular recesses or zones 37, 38 are thus provided in which a plasma cushion is able to be formed in a known manner by the respective metal films or foils 34 and 35. Additionally, a plasma cushion is formed by the plasma-forming substance 36 behind the propelling cage sabot 30 in a region 39. Each of the plasma arc cushions generated behind each of the sections 31, 32 and 33, in a manner to be described below, acts as an armature and accelerates the projectile. As further shown in FIG. 1, the projectile 20 and the propelling cage sabot segments 31, 32 and 33 are surrounded by a sleeve 40 of insulating material which, in a manner to be described below, ensures that only one pair of rails 11-12, 13-14, or 15-16 is in contact with a respective plasma-forming zone 37, 38 or 39.

Propelling cage segments 31 to 33 are preferably produced of insulating material (e.g. of epoxy resin). Insulating sleeve 40 may be composed, for example, of polycarbonate. Tube 10 may also be manufactured of an epoxy resin material. Primarily copper-chromium alloys and copper-tungsten alloys have been found to be satisfactory rail materials, as they are particularly wear resistant. For the metal foils 34, 35 and 36, aluminum or copper foils of a thickness of about 1 mm have been found to be satisfactory.

Figure 4:
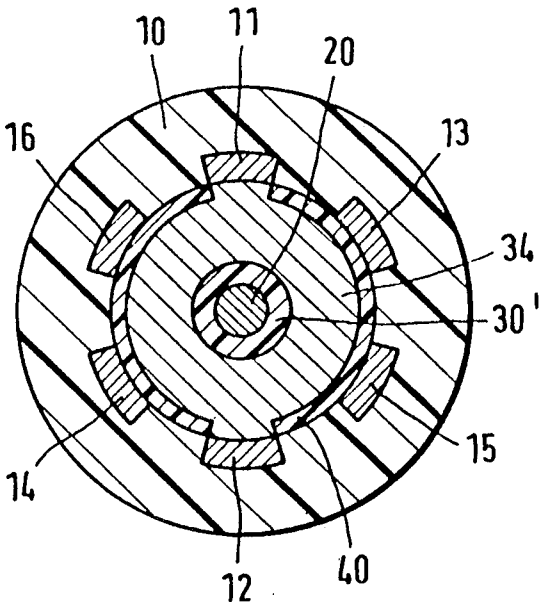
FIGS. 2 to 4 are cross-sectional views of the rail accelerator according to FIG. 1 seen along section lines I—I, II—II and III—III, respectively.
Figure 3:
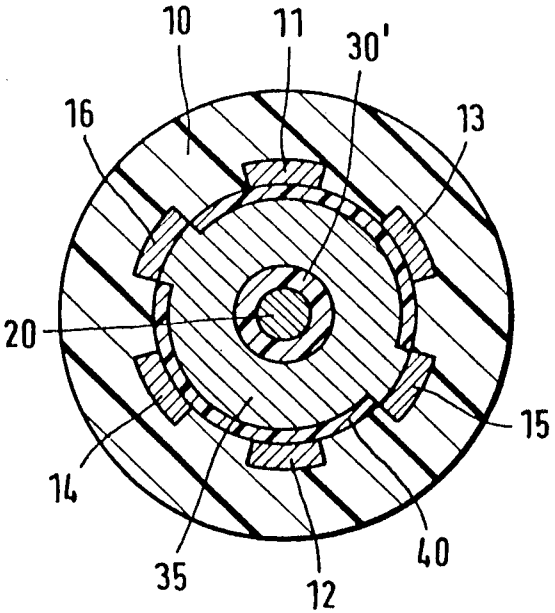
Figure 2:
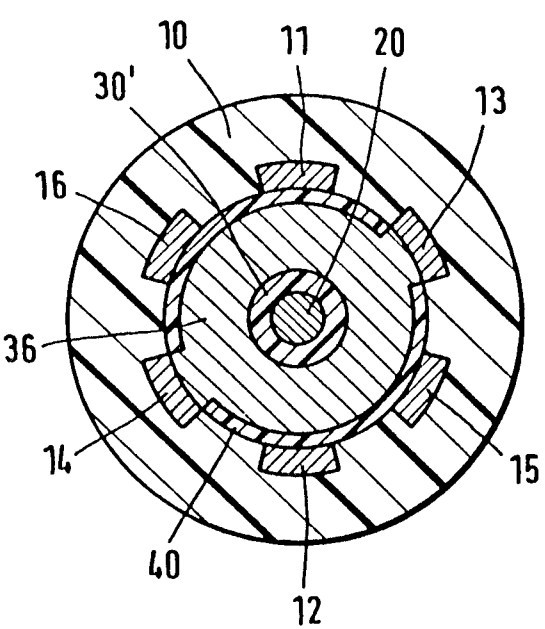

FIGS. 2 to 4 are cross-sectional views of the rail accelerator according to FIG. 1 along the stated section lines I—I, II—II and III—III, respectively. In these Figures, corresponding parts bear the same reference numerals as in FIG. 1. Clearly visible in FIGS. 2–4 are the three uniformly distributed pairs of opposing rails 11-12, 13-14, and 15-16, which are inserted into the inner surface of the cylindrical plastic tube 10. As can be seen in FIG. 2, the portion of the sleeve of insulating material 40 adjacent the zone 39 is provided with recesses or openings facing only the pair of rails 13 and 14 so that only the plasma-forming substance 36 extends to the surface of the sleeve 40 and contacts the rails 13 and 14, whereby these rails furnish current only for this plasma-forming zone 39. In a similar manner as shown in FIG. 3, the rails 15 and 16 are in contact with only the plasma-forming substance 35 via respective openings in the sleeve 40 and, as shown in FIG. 4, rails 11 and 12 are in contact with only the plasma-forming substance 34 via respective openings in the sleeve 40. Thus, three separate sets or pairs of rails are provided for the three zones in which a plasma arc is to be generated, and with each pair of rails furnishing current for a respective one of the three zones.

Figure 5:
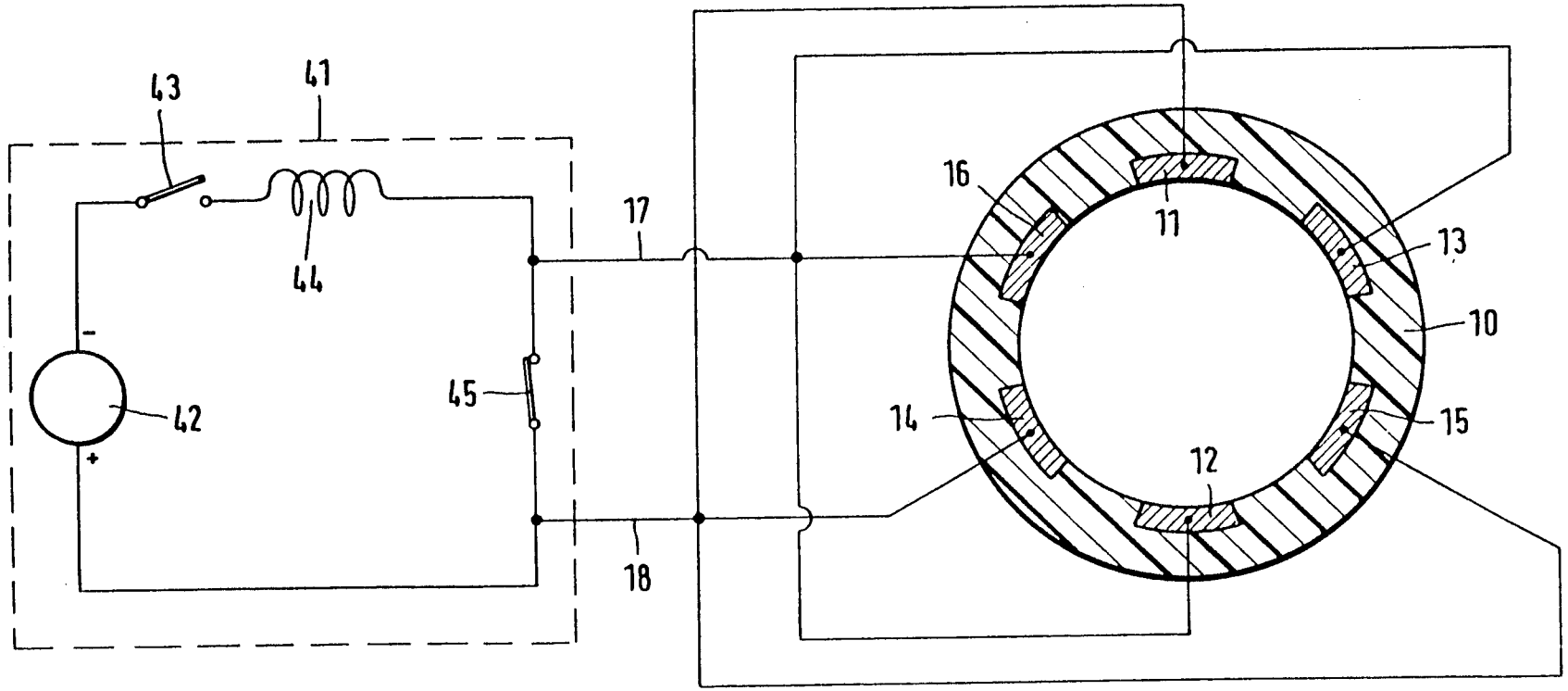
FIG. 5 is a circuit diagram of the current supply arrangement for the rail accelerator according to the invention.

FIG. 5 is a schematic representation of the current supply for the electromagnetic cannon or accelerator 1. The current supply unit 41 is composed essentially of the series connection of a direct current generator 42, a first switch 43, a coil or inductive energy store 44, and a second switch 45. The connection between the current supply unit 41 and the electromagnetic rail accelerator 1 is effected via lines 17 and 18, with the positive pole of generator 42 being connected with rails 14, 15 and 11 and the negative pole being connected with rails 12, 13 and 16. Thus the three pairs of rails are connected in parallel, with the current in each two adjacent rails, e.g. 16, 11, being of opposite polarity.

The following will serve to briefly explain the operation of the electromagnetic projectile acceleration device according to FIGS. 1 to 5.

First, switches 43 and 45 of current supply unit 41 are closed. This causes direct current generator 42 to charge the coil or inductive energy store 44. Then switch 45 is opened, thus generating a voltage across lines 17 and 18 and thus across the respective rail pairs 11-12, 13-14, and 15-16. The plasma-forming foils (e.g. metal foils) 34, 35 and 36 must be configured in such a manner that they evaporate into electrically conductive plasma clouds. This causes electric arcs to form at the rear ends of propelling cage sabot segments 31, 32 and 33 and a closed circuit to be established between the two rails of each of the respective rail pairs. This circuit is composed of inductive energy store 44, respective acceleration rail pairs 11-12, 13-14, and 15-16, and the plasma cushions behind propelling cage segments 34, 35 and 36. The current flow generated in this manner causes projectile 2 to be electromagnetically accelerated to very high velocities.

When projectile 2 exits from tube 10, switch 45 is closed so that now inductive energy store 44 is recharged by generator 42 for the next launching process.

Figure 6:
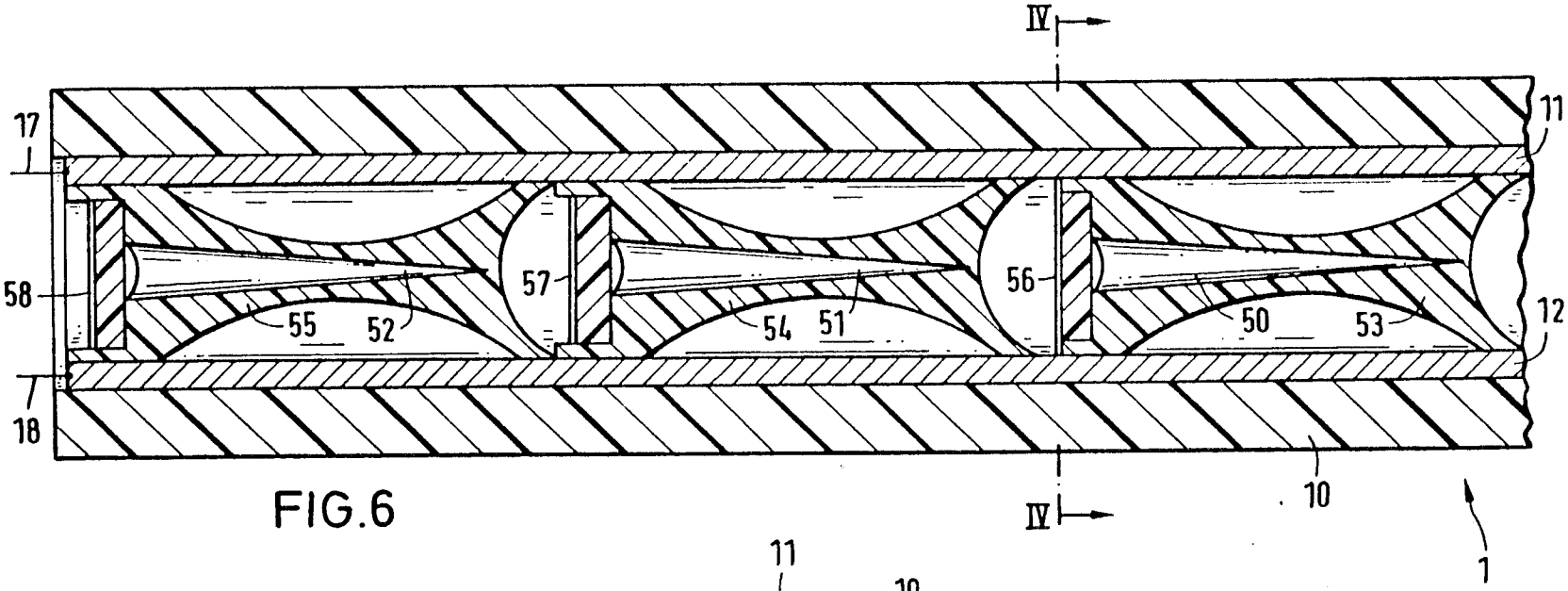
FIG. 6 is a longitudinal sectional view of an electromagnetic rail accelerator having three projectiles arranged one behind the other according to a further embodiment of the invention.

FIG. 6 shows a further embodiment of the present invention in which the projectile arrangement to the accelerated by means of the rail accelerator 1 is an arrangement composed of a plurality of individual projectiles arranged behind one another in the axial direction. The rail accelerator 1 is configured as in FIGS. 1–4 i.e., it is provided with three pairs of rails 11-12, 13-14 and 15-16, and therefore, in accordance with the basic invention, three projectile devices are shown. Each of the three projectile devices include a subcaliber projectile 50, 51 or 52, and a respective propelling cage sabot 53, 54 or 55. The rear or tail end surfaces of the propelling cage sabots 53, 54 and 55 are again provided with plasma-forming foils 56, 57 and 58, respectively. The energy supply for the accelerator 1 may here be configured as described above for the embodiment according to FIGS. 1 to 5. The operation of the acceleration device corresponds to the above-described device employing only one projectile.

Figure 7:
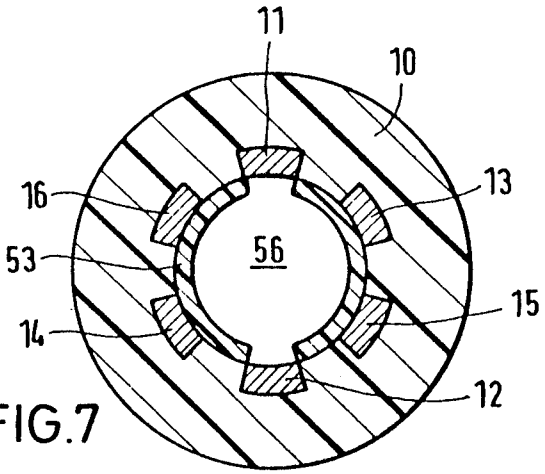
FIG. 7 is a cross-sectional view of the rail accelerator of FIG. 6 see along section line IV—IV.

FIG. 7 is a cross-sectional view of the rail accelerator of FIG. 6 seen along line IV—IV, i.e., looking toward the rear surface of projectile device 50-53. The rails are again marked 11 to 16 and the tube is marked 10. As can be seen, the peripheral surface of the sabot 53 is provided with recesses or openings only facing the rail pair 11-12, so that the foil 56 can only contact this pair of rails. As can be seen in FIG. 6, the foils 57 and 58 do not contact the rails 11 or 12 but rather are spaced therefrom by the rear portion of the respective sabots 54 and 55. It is understood that, although not shown, each of the foils 57 and 58 is connected to a respective one of the other rail pairs in a manner similar to that shown for foil 56.

The advantage of the multiple projectile arrangement is that in this way the firing cadence can be multiplied. This is important for anti-aircraft applications, specifically when fast-flying objects are encountered.

It will be understood that the above description of the present invention is susceptible to various modifications, changes and adaptations, and the same are intended to be comprehended within the meaning and range of equivalents of the appended claims.

What is claimed is:

1. In an electromagnetic rail accelerator for the acceleration of a projectile arrangement in combination with a projectile arrangement defining a plurality of axially spaced zones in each of which a respective plasma arc cushion is to be generated, with said accelerator including at least one pair of parallel axially extending diametrically opposed conductive rails disposed in the inner surface of a cylindrical tube of insulating material, a source of d.c. voltage, and means for selectively connecting said source across said at least one pair of conductive rails to produce a plasma arc; the improvement wherein: said rails are axially coextensive and are uniformly disposed about said inner surface of said tube; a number of pairs of axially extending diametrically opposed conductive rails are provided and are uniformly disposed in said inner surface of said tube; said pairs of rails are all connected in parallel; and said number of said pairs of rails is equal to the number of said plurality of zones in which a respective plasma is to be formed.

2. An electromagnetic rail accelerator as defined in claim 1, wherein: said number of accelerator rail pairs is a multiple of three; and said rail pairs are connected in parallel such that adjacent rails are connected to opposite poles of said source.

3. An electromagnetic rail accelerator as defined in claim 1 wherein said projectile arrangement includes: a subcaliber projectile provided with a propelling cage sabot having at least two axially spaced radially extending propelling cage segments arranged one behind the other and separated by intermediate members; and a respective film of a plasma forming substances disposed on the rear end surface of each said segment.

4. An electromagnetic rail accelerator as defined in claim 3 further comprising means, disposed on the peripheral surface of said propelling cage sabot, for causing each of said films of a plasma forming substance to contact only the two rails of a respective one of said number of pairs of rails.

5. An electromagnetic rail accelerator as defined in claim 4 wherein said means for causing comprises a cylindrical sleeve of insulating material surrounding said segments and having radially extending recesses adjacent the respective rails in the area of the respective said zones, and the respective films extend to the surface of said cylinder within the respective said recesses.

6. An electromagnetic rail accelerator as defined in claim 1 wherein said projectile arrangement includes a plurality of subcaliber projectiles, each provided with a propelling cage sabot, disposed axially one behind the other in said tube, and with the rear end surface of each said sabot being provided with a film of a plasma forming substance.

7. An electromagnetic rail accelerator as defined in claim 6 wherein each said sabot includes means, disposed at its respective said rear end surface, for causing the respective said film of a plasma forming substance to contact only the two rails of a respective one of said number of pairs of rails.

8. In a method of accelerating a subcaliber projectile, which is provided with a propelling cage sabot having at least two axially spaced radially extending propelling cage segments which are separated by intermediate members, by means of an electromagnetic accelerator of the type wherein a plasma arc cushion is formed between a pair of diametrically opposed conductive rails disposed on the inner surface of a nonconductive cylindrical accelerator tube in which the projectile is disposed, said method including accelerating the projectile by simultaneously generating a plasma arc behind each of said segments; the improvement comprising: providing a plurality of pairs of rails equal to the number of said plasma arcs to be generated; and causing each of the pairs of rails to generate a respective one of said plasma arcs.

9. In an electromagnetic rail accelerator for the acceleration of a projectile arrangement in combination with a projectile arrangement defining a plurality of axially spaced zones in each of which a respective plasma arc cushion is to be generated, with said accelerator including at least one pair of parallel axially extending diametrically opposed conductive rails disposed in the inner surface of a cylindrical tube of insulating material, a source of d.c. voltage, and means for selectively connecting said source across said at least one pair of conductive rails to produce a plasma arc; the improvement wherein: a number of pairs of axially extending diametrically opposed conductive rails are provided and are uniformly disposed in said inner surface of said tube; said pairs of rails are all connected in parallel; said number of said pairs of rails is equal to the number of said plurality of zones in which a respective plasma is to be formed; and said projectile arrangement includes a subcaliber projectile provided with a propelling cage sabot having at least two axially spaced radially extending propelling cage segments arranged one behind the other and separated by intermediate members, and a respective film of a plasma forming substance disposed on the rear end surface of each said segment.

10. An electromagnetic rail accelerator as defined in claim 9 further comprising means, disposed on the peripheral surface of said propelling cage sabot, for causing each of said films of a plasma forming substance to contact only the two rails of a respective one of said number of pairs of rails.

11. An electromagnetic rail accelerator as defined in claim 10 wherein said means for causing comprises a cylindrical sleeve of insulating material surrounding said segments and having radially extending recesses adjacent the respective rails in the area of the respective said zones, and the respective films extend to the surface of said cylinder within the respective said recesses.

* * * * *